US006154202A

United States Patent [19]

Hara et al.

[11] Patent Number: 6,154,202

[45] Date of Patent: Nov. 28, 2000

[54] IMAGE OUTPUT APPARATUS AND IMAGE DECODER

[75] Inventors: Hirotaka Hara, Pasadena, Calif.; Tadashi Saitoh, Koganei, Japan; Junichi Kimura, Hachioji, Japan; Yutaka Okunoki, Kawaguchi, Japan

[73] Assignees: Hitachi, Ltd.; Sega Enterprises, Ltd., both of Tokyo, Japan

[21] Appl. No.: 09/003,466

[22] Filed: Jan. 5, 1998

Related U.S. Application Data

[63] Continuation of application No. 08/559,276, Nov. 15, 1995, abandoned.

[30] Foreign Application Priority Data

Nov. 17, 1994 [JP] Japan ..... 6-283838

[51] Int. Cl.[7] ..... G09G 5/00

[52] U.S. Cl. ..... 345/213; 364/270.5

[58] Field of Search ..... 345/213, 153, 345/155, 132; 364/270.5, 270.9, 270.2–270.8; 370/298; 375/370, 66

[56] References Cited

U.S. PATENT DOCUMENTS

| | | | |
|---|---|---|---|
| 4,727,361 | 2/1988 | Tokumitsu | 340/703 |
| 4,748,618 | 5/1988 | Brown et al. | 370/94 |
| 4,837,680 | 6/1989 | Crockett et al. | 364/200 |
| 4,866,597 | 9/1989 | Kinoshita | 364/200 |
| 4,941,193 | 7/1990 | Barnsley et al. | 382/56 |
| 4,949,169 | 8/1990 | Lumelsky et al. | 358/86 |
| 5,045,853 | 9/1991 | Astle et al. | 341/67 |
| 5,177,624 | 1/1993 | Sato | 358/462 |
| 5,187,779 | 2/1993 | Jeddeloh et al. | 395/325 |
| 5,258,750 | 11/1993 | Malcolm, Jr. et al. | 340/721 |
| 5,313,302 | 5/1994 | Ohta et al. | 348/586 |
| 5,349,449 | 9/1994 | Omi et al. | 358/448 |
| 5,432,905 | 7/1995 | Hsieh et al. | 395/162 |
| 5,438,376 | 8/1995 | Watanabe | 345/200 |
| 5,461,679 | 10/1995 | Normile et al. | 382/304 |
| 5,465,104 | 11/1995 | Munson | 345/150 |
| 5,477,397 | 12/1995 | Naimpaly et al. | 360/18 |
| 5,539,467 | 7/1996 | Song et al. | 348/402 |
| 5,543,820 | 8/1996 | Edgar | 345/153 |
| 5,565,923 | 10/1996 | Zdepski | 348/423 |
| 5,566,003 | 10/1996 | Hara et al. | 382/199 |
| 5,866,597 | 2/1999 | Kinoshita | 364/200 |

FOREIGN PATENT DOCUMENTS

| | | |
|---|---|---|
| 81105520 | 7/1992 | Taiwan . |
| 82109737 | 11/1993 | Taiwan . |

*Primary Examiner*—Vijay Shankar
*Assistant Examiner*—Vanel Frenel
*Attorney, Agent, or Firm*—Antonelli, Terry, Stout & Kraus, LLP

[57] ABSTRACT

An image output apparatus capable of realizing asynchronous data access by a host controller in response to an image data transfer request from the host controller, by adding a minimum amount of circuitry to the image output apparatus without using an external data buffer. The image output apparatus includes: a storage device for storing image data; a display circuit for sequentially reading the image data from the storage device and converting the image data into image data capable of being displayed; a timing controller for controlling the operation timing of the display circuit; and an output circuit for changing an operation mode of the timing controller in response to a data transfer request from the host controller and allowing the image data corresponding in amount to the data transfer request to be outputted asynchronously.

4 Claims, 7 Drawing Sheets

TIMING CONTROLLER 10
10
sclk
5
HOST REQ.
3
HOST WAIT
20
ASYNCHRONOUS CLOCK GENERATOR
15
17
aclk
16
tran rdy
aclk
CONTROLLER
27
22
cnt
reset
30
28
wline end
29
rline end
SELECTOR
MDC
41
26
WRITE ADDRESS GENERATOR
R
25
READ ADDRESS GENERATOR
R
24
Raddr
23
Waddr

IMAGE OUTPUT APPARATUS AND IMAGE DECODER

This application is a continuation of application Ser. No. 08/559,276 filed on Nov. 15, 1995 ABN.

BACKGROUND OF THE INVENTION

1. Field of the Invention

The present invention relates to digital image processing technologies, and more particularly to effective technologies for a compressed image data decoder.

2. Description of the Related Art

Conventional technology in this field will be described with reference to FIG. 2B. A conventional image output apparatus 1 formats image data synchronously with a system clock sclk 5 and horizontal and vertical sync signals of a display device such as a CRT, and outputs the formatted image data. Since the image output apparatus 1 outputs image data of a predetermined format at a predetermined timing, an external data buffer 2 for temporarily storing the image data outputted from the image output apparatus 1 is required if a host controller 4 such as a microprocessor executes a so-called direct memory access (DMA) transfer. Upon reception of a data request host req signal from the microprocessor 4, the image data is asynchronously outputted from an output terminal data out 4' of the data buffer 2.

The conventional technology described with reference to FIG. 2B has been found, however, unsatisfactory because the data buffer 2 is required to be provided externally between the image output apparatus 1 and microprocessor 4. This data buffer 2 is required to have a memory capacity sufficient for the maximum amount of data per one DMA transfer. For example, the data buffer 2 is required to have a capacity of 352×3 pixels×2 per one line of RGB. Therefore, the amount of hardware increases.

SUMMARY OF THE INVENTION

It is an object of the present invention to provide an image output apparatus allowing a host controller to asynchronously access image data, by adding a minimum scale of circuitry to the image output apparatus without using a data buffer.

According to one aspect of the present invention solving the above problems, an image output apparatus having a storage device for storing image data, a display circuit for sequentially reading the image data from the storage device and converting the image data into image data capable of being displayed, and a timing controller for controlling the operation timing of the display circuit, is structured such that an operation mode of the timing controller is changed in response to a data transfer request from a host controller to which the image data is transferred, and the image data corresponding in amount to the data transfer request can be outputted.

According to another aspect of the present invention, the above-described structure includes an asynchronous clock generator for generating or stopping clocks in accordance with whether there is a data transfer request from the host controller.

The display circuit includes a buffer memory with a first-in, first-out function for storing the image data capable of being displayed, and the image data is sequentially outputted from the FIFO buffer memory in response to a data transfer request from the host controller.

According to another aspect of the present invention, the display circuit includes line buffers each for storing the image data of one scan line read from the storage device, and a filtering circuit for performing at least vertical and horizontal filtering processes for an output of the line buffers, wherein the operation mode of the timing controller is changed in accordance with a data transfer request from the host controller and the output timing of the line buffers and the operation timing of the filtering circuit are changed.

In the circuit structured as above, a data buffer necessary for DMA transfer of image data from the image output apparatus to the host controller is not needed. The internal operation clocks are turned on or off in accordance with a data transfer request from the host controller. Accordingly, asynchronous data transfer is possible and FIFO in the output stage circuit can be realized by only two buffers. Furthermore, data transfer to the host controller is performed by a handshaking manner so that the data transfer amount per one handshaking operation is not limited.

Other objects, features and advantages of the present invention will become apparent from reading the following description of embodiments in conjunction with the accompanying drawings.

DETAILED DESCRIPTION OF THE PREFERRED EMBODIMENTS

Figure 1:
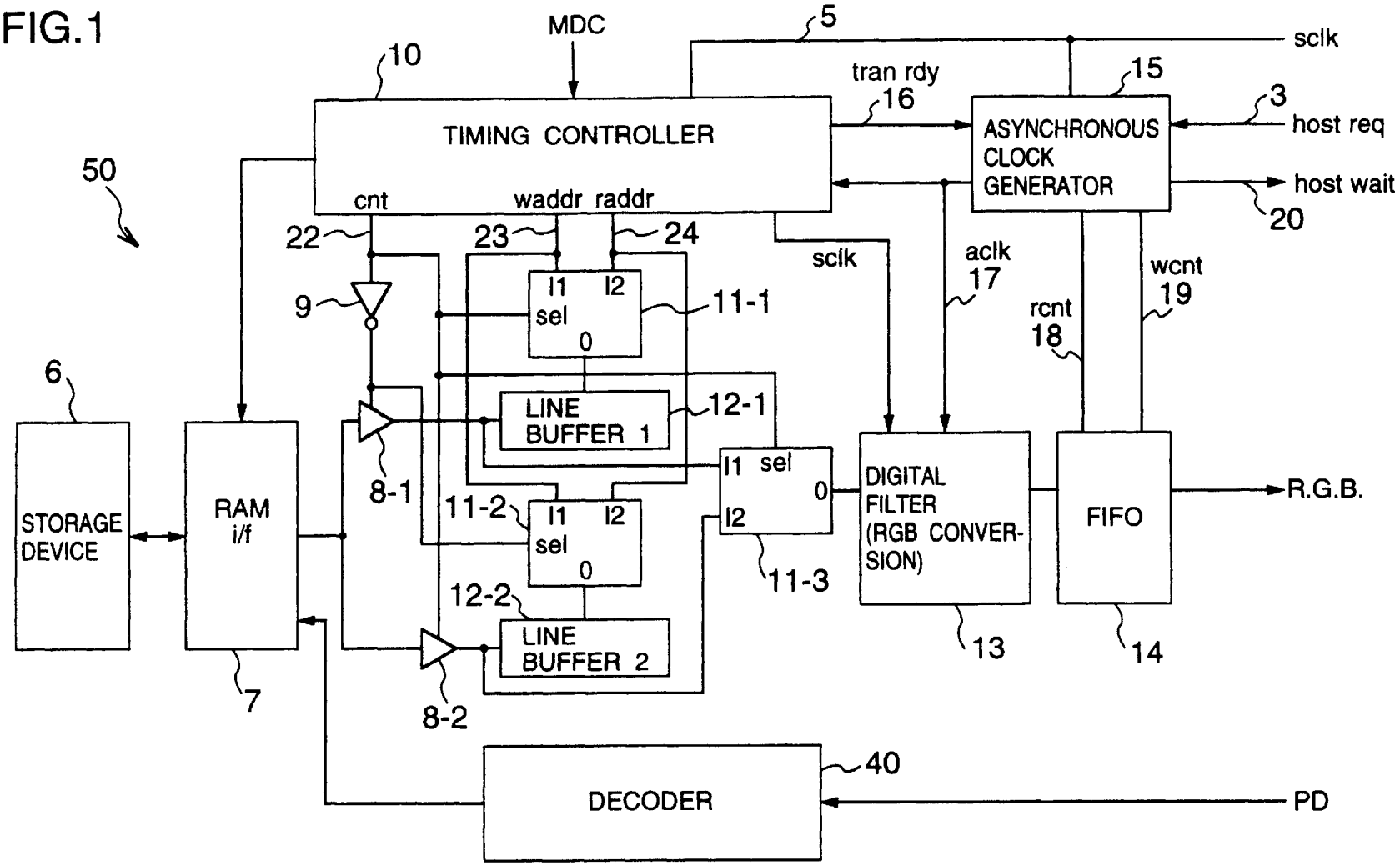
FIG. 1 is a block diagram of the circuit of an image output apparatus according to a typical embodiment of the invention.

A typical embodiment of the invention will be described with reference to FIGS. 1 and 2A. As shown in FIG. 2A, an image display system using an image output apparatus of the invention includes an image output apparatus 50, a host controller 60, and an image data storage device 70 such as a CD-ROM. The image output apparatus 50 of this embodiment includes a storage device 6 for storing image data and a moving picture decoder 40, which is called MPEG (moving picture expert group) decoder for decoding compressed and encoded image data. Image data PD still not decoded and supplied from the host controller 60, such as image data read from CD-ROM 70, is inputted to and decoded by the MPEG decoder 40, and stored via a RAM interface 7 in the storage device 6. The image output apparatus 50 reads image data from the storage device 6 via the RAM interface 7, and writes the image data via tri-state buffers 8-1 and 8-2 alternately into line-buffers 12-1 and 12-2, respectively under the control of a timing controller 10.

Although the invention is not limited to this, the RAM interface 7 is adapted to time-divisionally perform an operation of reading image data from the storage device 6 and supplying it to the line buffers 12-1 and 12-2 and an operation of writing image data decoded by the decoder 40 into the storage device 6. The RAM interface 7 has a built-in address counter. When the start address of a desired line is supplied from the timing controller 10 prior to reading the image data, the RAM interface 7 translates this start address into an address for the storage device 6, and automatically reads the image data from the storage device 6 while incrementing the address counter in response to a system clock sclk.

The line buffers 12-1 and 12-2 each have a storage capacity of one line of image data. The line buffers 12-1 and 12-2 are controlled by a switching control cnt signal 22 supplied from the timing controller 10 so that while image data is written in one of the line buffers, image data is read from the other line buffer. The timing controller 10 outputs a line buffer write address waddr signal 23 and a line buffer read address raddr signal 24. While the switching control cnt signal 22 takes a High level, the selectors 11-1 and 11-2 operate to supply the write address waddr to the line buffer 12-2 and the read address raddr to the line buffer 12-1.

Image data starting at the read address raddr and selectively read via a selector 11-3 from either line buffer 12-1 or the line buffer 12-2 is supplied to a digital filter 13. The digital filter 13 performs various processes such as converting a luminance signal Y (or chrominance signal C) into RGB (red, green, blue) signals, interpolation filtering between horizontal lines, and interpolation filtering between vertical lines. An output of the digital filter 13 is supplied to a first-in, first-out register (FIFO) 14 functioning as a buffer. FIFO 14 sequentially loads the output of the digital filter 13 in its latch circuits or registers in response to a write control wcnt signal 19 supplied from an asynchronous clock generator 15, and outputs the loaded data in response to a read control rcnt signal 18 from the asynchronous clock generator 15.

In a usual image output mode, the timing controller 10 controls the digital filter 13 to operate synchronously with a system clock sclk 5 and output image data at a predetermined period via FIFO 14 to the host controller or host CPU 60. The host CPU 60 generates a mode switching signal MDC which switches between a synchronous read mode and an asynchronous read mode. In the synchronous read mode, image data is read at TV signal timings, whereas in the asynchronous mode, image data is read at CPU timings.

Upon reception of the mode switching signal MDC from the host CPU 60, the timing controller 10 stops a supply of the system clock sclk 5 to the digital filter 13, and allows the asynchronous clock generator 15 to supply a non-periodical and asynchronous clock aclk 17 to the digital filter 13. Starting from this timing, the asynchronous clock generator 15 operates in the asynchronous read mode different from the usual image output mode. In the asynchronous read mode, image data is asynchronously read in response to a data request host req signal 3 supplied from the host CPU 60.

Specifically, if the asynchronous clock generator 15 receives from the host CPU 60 the data request host req signal 3 requesting a transfer of one pixel image data and receives from the timing controller 10 a transfer ready trn rdy signal 26 of the High level indicating a data transfer ready state of the line buffer 12-1, 12-2, then the asynchronous clock generator 15 supplies the asynchronous clock aclk signal 17 synchronizing with the system clock sclk 5 to the digital filter 13 which in turn outputs image data. On the other hand, if the asynchronous clock generator 15 does not receive the one pixel image data transfer request from the host CPU 60 or if the transfer ready tran rdy signal 16 is of a Low level, i.e., if the line buffer 12-1, 12-2 cannot output image data, then the asynchronous clock aclk signal 17 is changed to the Low level to stop outputting image data.

If the line buffer 12-1, 12-2 cannot output image data because of some reason on the side of the image output apparatus, the asynchronous clock generator 15 supplies a host wait host wait signal 20 of the High level to the host CPU 60 to suspend the data transfer request. The timing controller 10 has a function of reading data from and wiring data to the line buffers 12-1 and 12-2. In the asynchronous read mode, the timing controller 10 operates synchronously with the asynchronous clock aclk signal 17 from the asynchronous clock generator 15. If the line buffer 12-1, 12-2 cannot output image data because of some reason on the side of the image output apparatus, the timing controller 10 changes the transfer ready trn rdy signal 16 to the Low level. Although the transfer ready trn rdy signal 16 has the equivalent meaning to the host wait host wait signal 20, these timings are different. Namely, the host wait host wait signal 20 is changed to the Low level after the asynchronous clock generator 15 recognizes the High level of the transfer ready trn rdy signal 16. When the transfer ready trn-rdy signal 16 changes to the Low level, the host wait host wait signal 20 changes to the High level at the same timing.

Figure 2A:
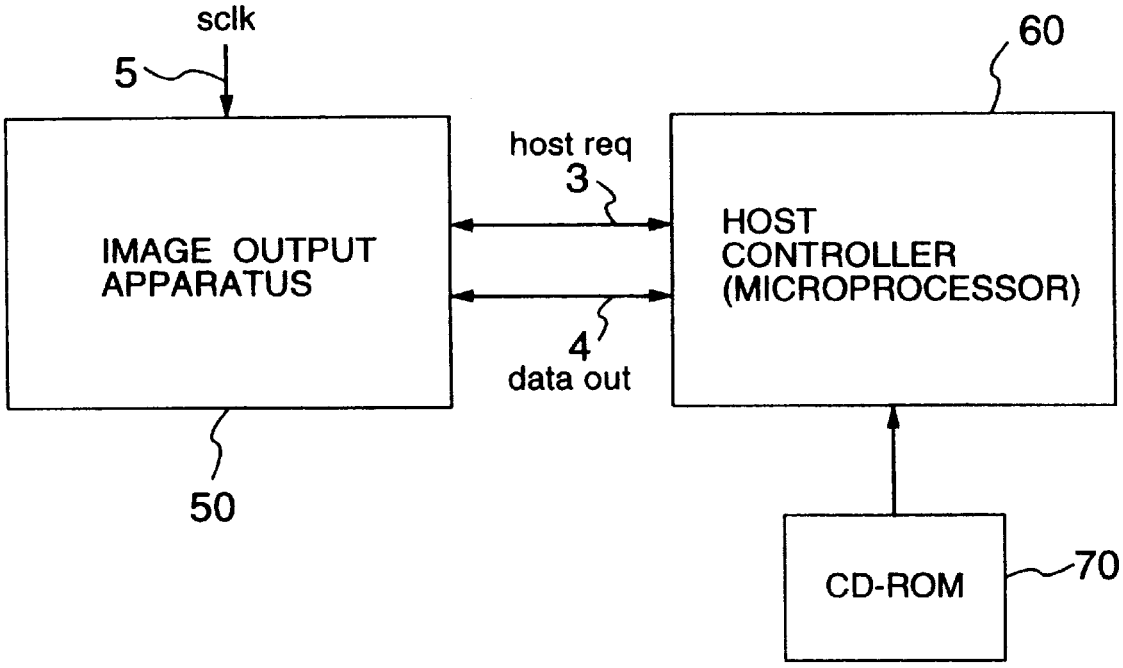
FIG. 2A is a block diagram showing an example of a system using the image output apparatus of this invention.
Figure 2B:
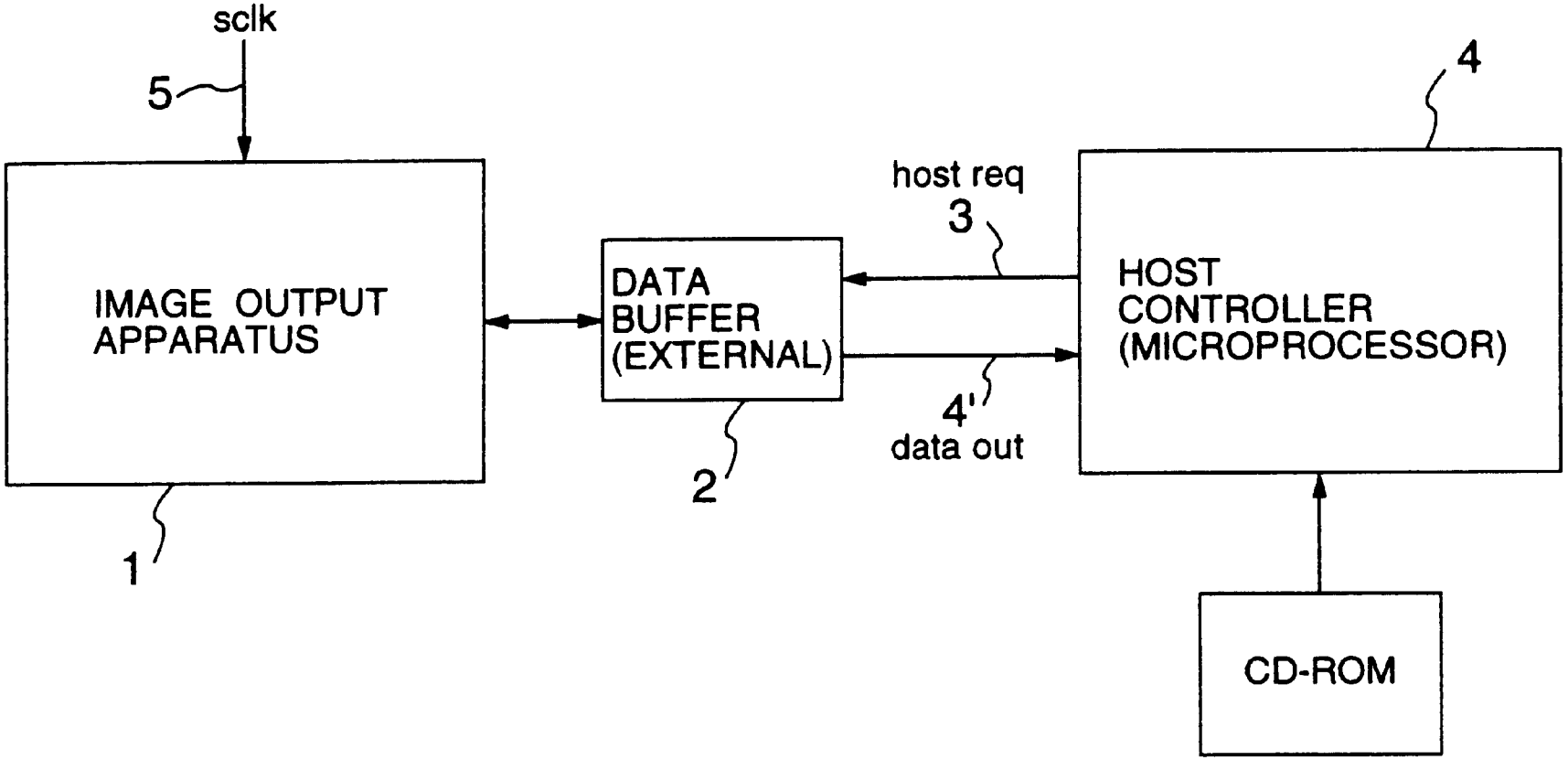
FIG.2B PRIOR ART
FIG. 2B is a block diagram showing an example of the system using a conventional image output apparatus.
Figure 3:
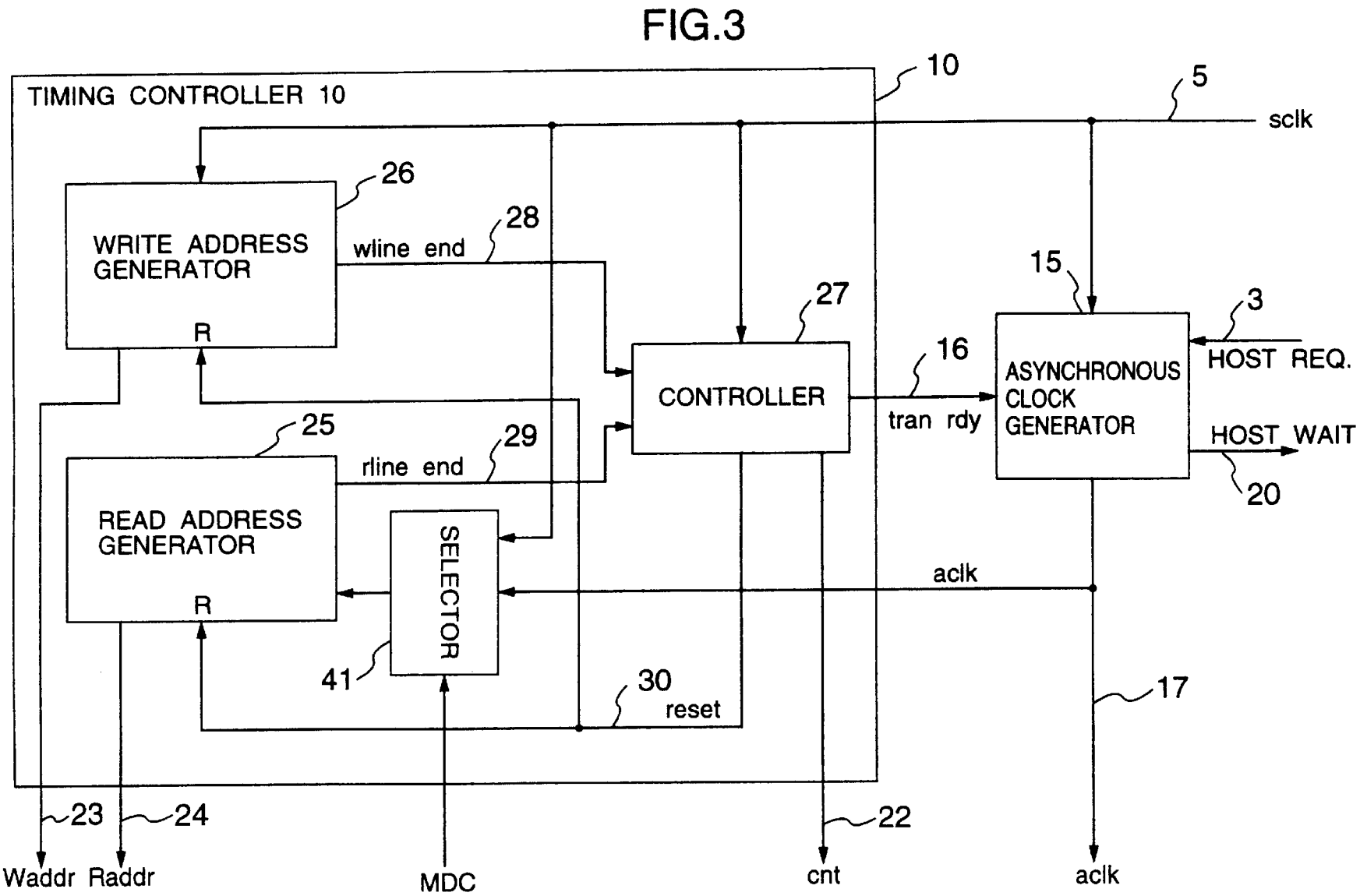
FIG. 3 is a block diagram showing an example of the circuit of the timing controller 10 of the embodiment shown in FIG. 1.
Figure 4:
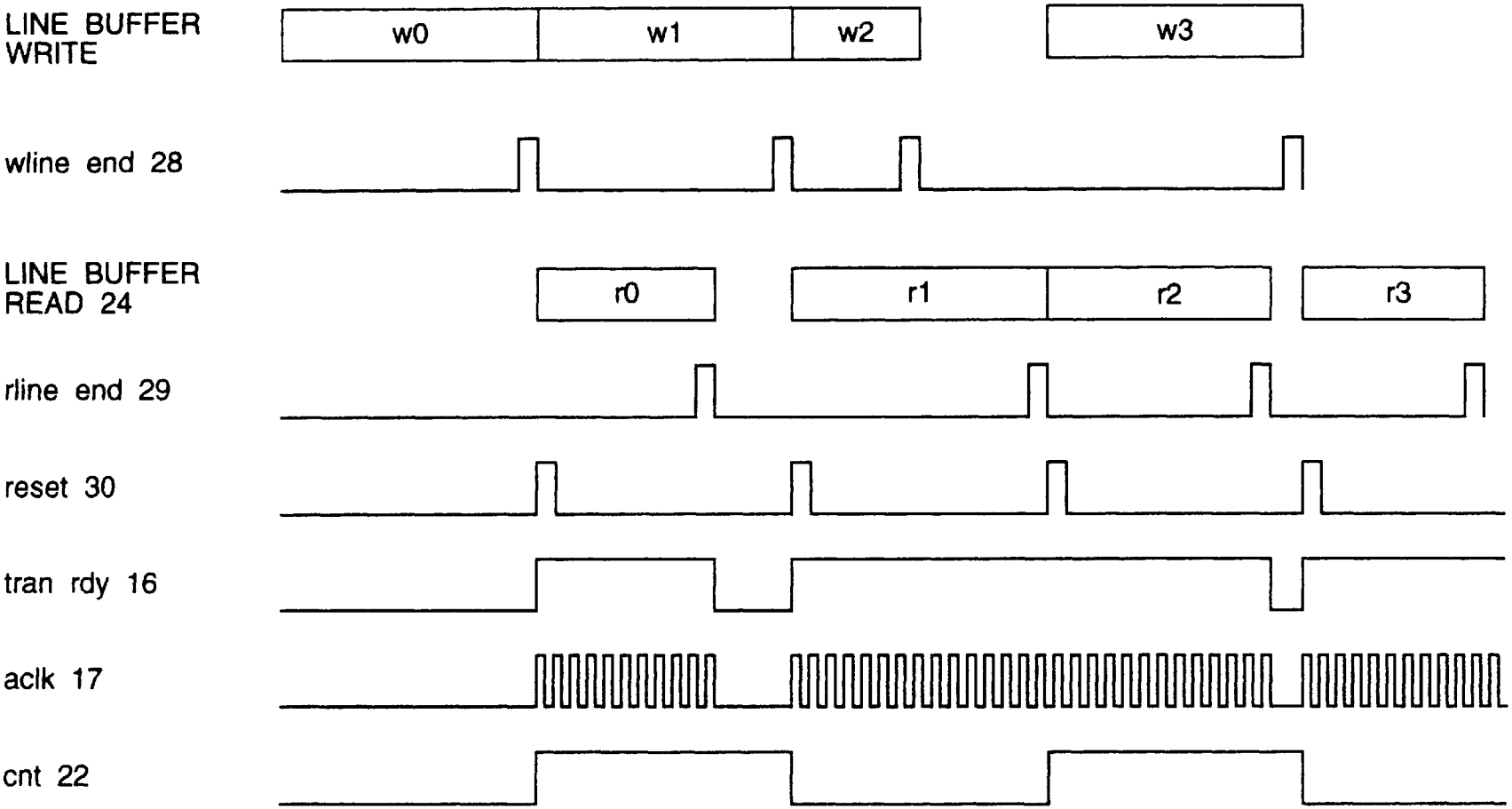
FIG. 4 is a timing chart showing operation timings of the timing controller 10.

An embodiment of the timing controller 10 shown in FIG. 1 is detailed in FIG. 3, and its operation timings are illustrated in FIG. 4. The timing controller 10 includes a write address generator 26, a read address generator 25, a controller 27, and a selector 41 for selecting either the system clock sclk or the asynchronous clock aclk in accordance with the mode change MDC signal. The write address generator 26 starts its operation in response to a reset reset signal 30 from the controller 27. In an usual case, image data of one line is written in the line buffer 12-1, 12-2 and a write address Waddr signal 23 is incremented from "0" each time the system clock sclk is supplied. When the write address for the last image data of one line is outputted, a line write end wline end signal 28 is outputted to the controller 27 to thereafter stop the address increment operation. In FIG. 4, one-line write periods are indicated by w0, w1, w2, and w3. The different time durations thereof indicate different amounts of transferred data in one line.

Similarly, the read address generator 25 starts its operation in response to a reset reset signal 30 from the controller 27. The read address generator 26 counts the asynchronous clock aclk signal 17 selected by the mode change MDC signal upon reception of a data request from the host CPU 60. A read address Raddr signal 24 is incremented from "0" each time the asynchronous clock aclk is supplied. When the read address for the last image data of one line is outputted, a line read end rline end signal 29 is outputted to the controller 27 to thereafter stop the address increment operation.

In FIG. 4, one-line read periods are indicated by r0, r1, r2, and r3. The different time durations thereof indicate different amounts of transferred data in one line, and asynchronous generation of a transfer request at the host CPU 60, i.e., intermittent generation of the asynchronous clock aclk signal 17.

The controller 27 controls the operations of the read and write address generators 25 and 26, synchronously with the system clock sclk signal 5. When the line buffer write period w0 ends and the line write end wline end signal 28 is received from the write address generator 26, the controller 27 outputs the address reset reset signal 30. At this time, since the line buffer 12-1, 12-2 becomes ready for an image data output, the controller 27 changes the data transfer ready trn rdy signal 16 from the Low level to the High level.

Next, the line buffer write period w1 (1st line) starts and the line buffer read period r0 (0th line) starts. In the example shown in FIG. 4, since the line buffer read period r0 terminates first, it is necessary to wait for the termination of the line buffer write period w1 prior to starting the next line buffer read period r1. During this wait period, the controller 27 changes the transfer ready trn rdy signal 16 to the Low level to suspend the data transfer to the host CPU 60. When the line write end wline end signal 28 is received, the controller 27 issues the reset signal 30 and changes the transfer ready trn rdy signal 16 to the High level, to thereby prepare for the next line read/write operations (w2, r1). The line buffer write period w2 and line buffer read period r1 shown in FIG. 4 indicates that the write operation is first completed and the read operation is next completed. In this case, since image data for the line buffer read period r2 can be transferred when the line read end rline end signal 29 takes the High level, the transfer ready trn rdy signal 16 is not required to be changed to the Low level.

The advantages of the embodiment shown in FIG. 3 are as follows. Since the write address generator 26 for controlling data write into the line buffers 12-1 and 12-2 shown in FIG. 1 operates synchronously with the system clock sclk, the transfer time of one line is proportional to the number of transferred pixels and does not depend on the transfer request from the host CPU 60. Therefore, after the write operation into the line buffer 12-1, 12-2 is completed, the RAM interface 7 can be assigned another task. For example, in the case of a compressed data decoder in conformity with the MPEG video specifications, the RAM interface 7 has many operations other than data transfer to the line buffers 12-1 and 12-2, such as input/output of compressed image data, input/output of reference image data, and input/output of decoded data, and executes these operations time-divisionally. According to the embodiment, unnecessary overhead to be caused by the wait time for a data request from the host CPU 60 can be avoided.

Figure 5:
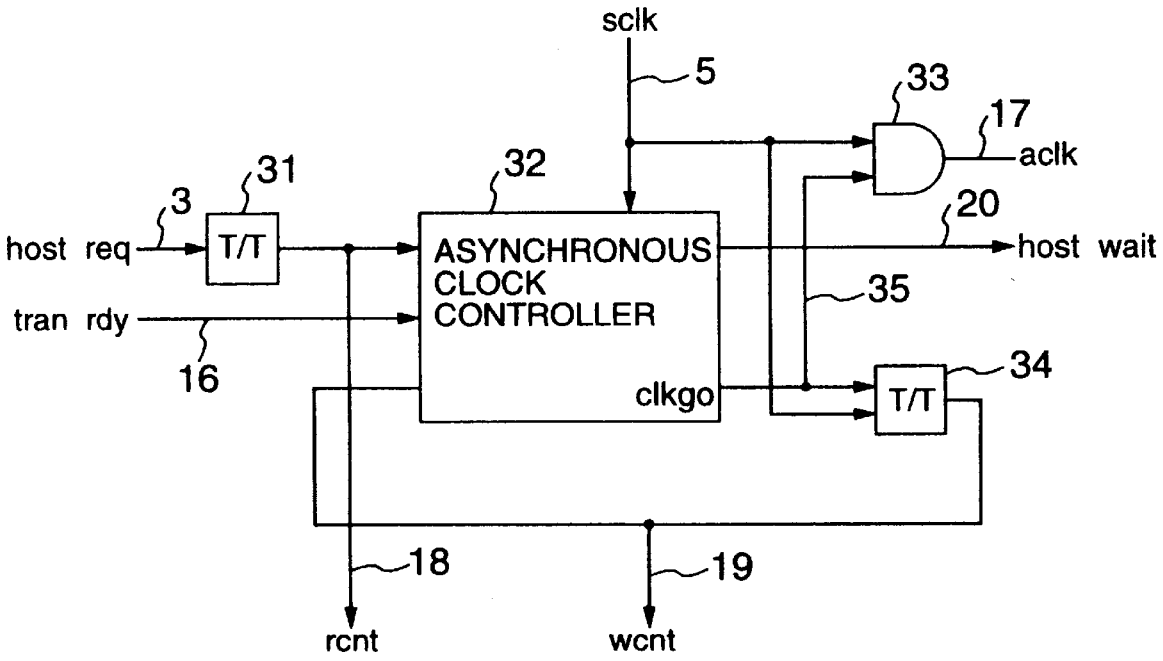
FIG. 5 is a block diagram showing an example of the circuit of the asynchronous clock generator 15 of the embodiment shown in FIG. 1.
Figure 6:
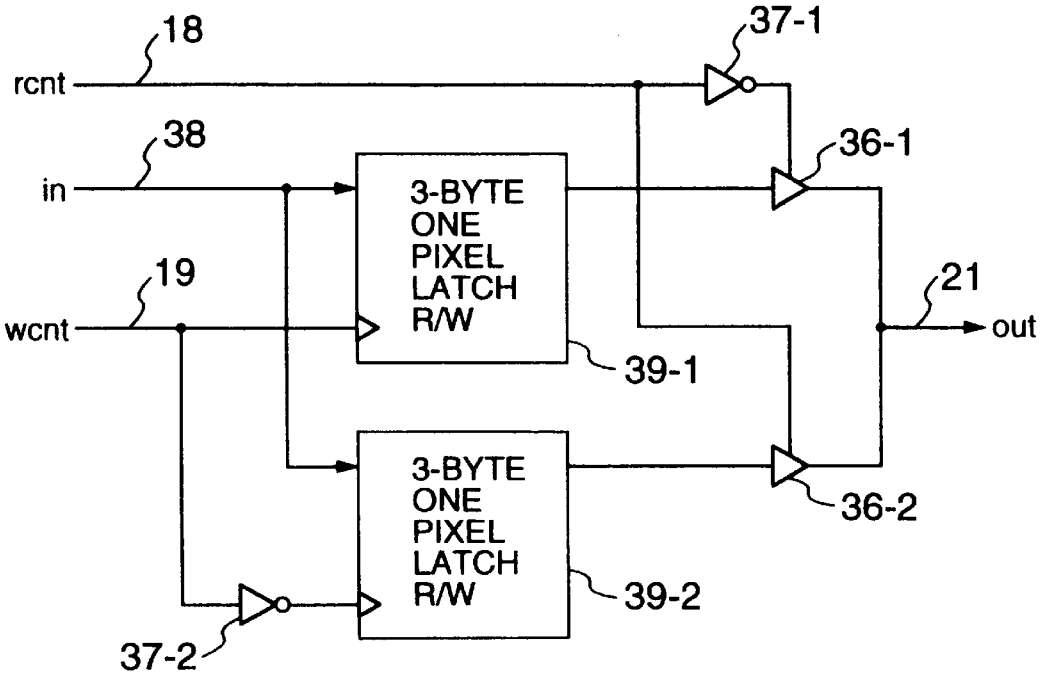
FIG. 6 is a block diagram showing an example of the circuit of FIFO 14 of the embodiment shown in FIG. 1.

FIG. 5 shows the detailed embodiment of the asynchronous clock generator 15 shown in FIG. 1, and FIG. 6 shows the detailed embodiment of FIFO 14 shown in FIG. 1. The asynchronous clock generator 15 has a toggle type flip-flop 31 which changes its output at the falling edge of the data request host req signal 3 from the host CPU 60. The read control rcnt signal 18 to be outputted from this flip-flop 31 alternately changes its level between the High and Low levels each time the data request host req signal 3 falls. This read control rcnt signal 18 is outputted to FIFO 14, and as shown in FIG. 6, inputted via an inverter 37-1 to a tri-state buffer 36-1 and directly to another tri-state buffer 36-2 to thereby select either the output of a latch circuit 39-1 or a latch circuit 39-2.

An asynchronous clock controller 32 shown in FIG. 5 changes a clkgo signal 35 (indicating availability of an asynchronous transfer) to the High level during one period of the system clock sclk 5 if the transfer ready trn rdy signal 16 from the timing controller 10 is of the High level and when the read control rcnt signal 18 changes. The clkgo signal 35 is outputted to an two-input AND gate 33 to obtain a logical product between the clkgo signal 35 and system clock sclk signal 5, this logical product being the asynchronous clock aclk signal 17. The clkgo signal 35 is also inputted to a toggle type synchronous flip-flop 34 with a clock sclk. As the clkgo signal 35 changes, the write control wcnt signal 19 alternately changes its level between the High and Low levels at the timings of the system clock sclk 5. In other words, the asynchronous clock controller 32 performs a handshaking control between the read control rcnt signal 18 and write control wcnt signal 19 while the transfer ready trn rdy signal 16 takes the High level.

The write control wcnt signal 19 outputted from the flip-flop 34 is supplied to FIFO 14 and is used as a clock of the latch circuits 39-1 and 39-2 serving as a buffer of FIFO 14 shown in FIG. 6. Since the write control wcnt signal is supplied via an inverter 37-2 to the latch circuit 39-2, an input in 38 supplied from the digital filter 13 is alternately written in the latch circuits 39-1 and 39-2.

The asynchronous clock controller 32 shown in FIG. 5 changes the clkgo signal 35 to the Low level and the host wait host wait signal 20 to the High level when the transfer ready trn-rdy signal 16 from the timing controller 10 takes the Low level. When the clkgo signal 35 changes to the Low level, the data request by the host CPU 60 is suspended. The following operation is performed if the response of the host CPU 60 to the host wait host wait signal 20 is delayed.

Since FIFO 14 has two buffers (latch circuits), data of one pixel can be outputted after the host wait host wait signal 20 is changed to the High level. If the host CPU 60 reads excessive data from FIFO 14, the relationship between the read control rcnt signal 18 and write control wcnt signal 19 changes. The asynchronous clock controller 32 detects this change in the relationship between the read control rcnt signal 18 and write control wcnt signal 19. If the host CPU 60 reads excessive data and the High level of the transfer ready trn rdy signal 16 is detected while the host wait host wait signal 20 takes the High level, then the asynchronous clock controller 32 inverts the write control wcnt signal 19, loads image data capable of being outputted, into one of the two buffers 39-1 and 39-2 of FIFO 14, and thereafter changes the host wait host wait signal 20 to the Low level to resume the data transfer to the host CPU 60.

Figure 7:
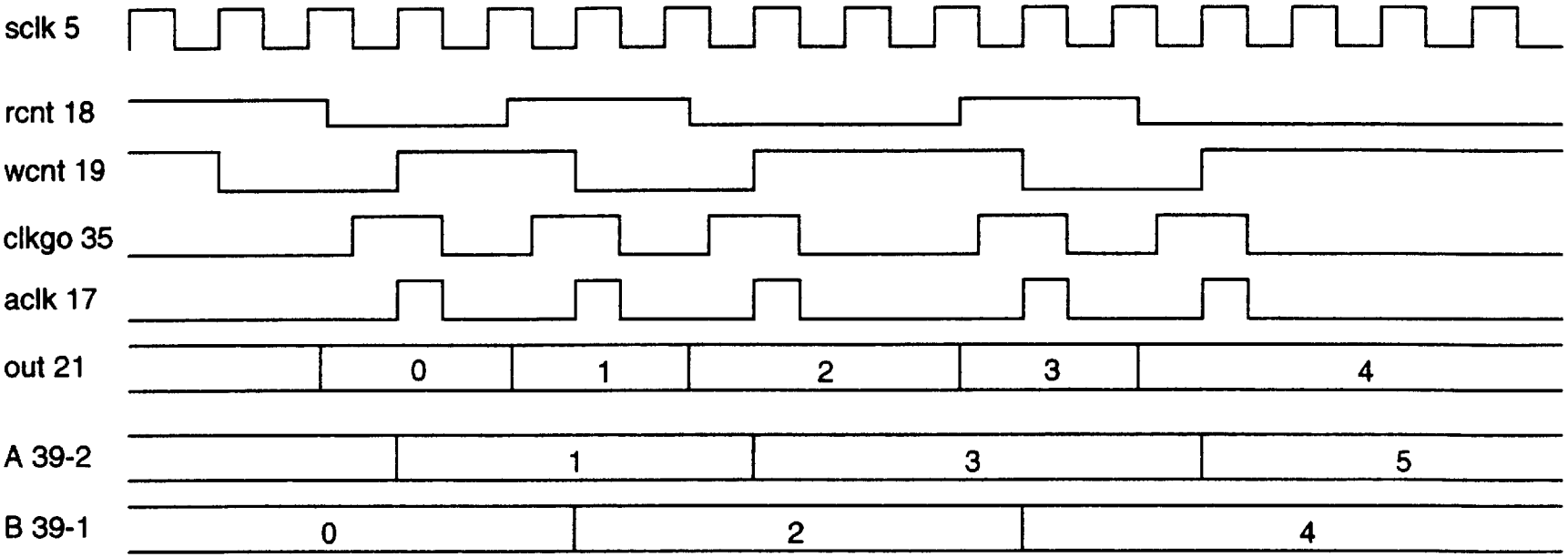
FIG. 7 is a timing chart showing operation timings of the circuits shown in FIGS. 5 and 6.

FIG. 7 shows operation timings of the embodiment circuits shown in FIGS. 5 and 6. Each time the write control wcnt signal 19 changes, 0th, 2nd, and 4th image data are written in the latch circuit 39-1, and 1st, 3rd, and 5th image data are written in the latch circuit 39-2. Each time the read control rcnt signal 18 changes, image data in the latch circuits 39-1 and 39-2 are alternately read. As a result, the image data is read from FIFO 14 in the order of 0th, 1st, 2nd, 3rd, and 4th. In this manner, asynchronous transfer to the host CPU 60 can be realized by a simple control circuit only by providing two FIFOs at the output stage.

The invention made by the inventor has been described in detail with reference to the above embodiments. The invention is not limited only to the above embodiments, but obviously various modifications can be made without departing from the true spirit and scope of the invention.

According to the invention, an external data buffer conventionally used is not necessary. With the image output apparatus of this invention, data transfer to the host CPU can be performed by a handshaking manner. Accordingly, the data transfer amount per one handshaking operation is not limited.

What is claimed is:

1. An image output apparatus capable of allowing a host controller to perform asynchronous data access, comprising:

a decoder circuit decoding compressed and encoded input image data;

a storage device coupled to the decoder circuit and storing decoded image data supplied from the decoder circuit;

a buffer circuit coupled to the storage device and reading and storing the decoded image data from the storage device;

a conversion circuit coupled to the buffer circuit and converting the decoded image data supplied from the buffer circuit into image data capable of being displayed, the image data capable of being displayed being red, green and blue signals;

an output circuit coupled to the conversion circuit and outputting the image data capable of being displayed which is output from the conversion circuit;

a timing controller, coupled to receive system clocks and to receive a mode change signal to be provided from the host controller, for controlling the operations of the buffer circuit, the conversion circuit and the output circuit in synchronism with the system clocks when receiving the mode change signal of a first level that indicates a synchronous data access mode where data transfer operations are synchronous with the system clocks, wherein the timing controller is responsive to the mode change signal of a second level that indicates an asynchronous data access mode and stops a supply of the system clocks to the conversion circuit; and an asynchronous controller coupled to receive the system clock and responsive to one or more data requests to be provided from the host controller in the asynchronous data access mode and controlling operations of the conversion circuit and the output circuit, wherein the asynchronous controller supplies to the conversion circuit a clock signal which is changed in synchronism with the system clocks in response to an application of the one or more data requests, and wherein the asynchronous controller controls output operations of the output circuit in response to an application of the one or more data requests so that the host controller receives desired numbers of pixel data in the asynchronous data access mode.

2. An image output apparatus according to claim 1, wherein one data request indicates a data transfer of one pixel data to the host controller.

3. An image output apparatus according to claim 1, wherein the buffer circuit includes a pair of line buffers, one being in a read mode while the other is in a write mode, and wherein the timing controller includes a read address counter and a write address counter, wherein the read address counter outputs read addresses in synchronism with the system clocks when receiving the mode change signal of the first level and outputs the read addresses in synchronism with the clock signal when receiving the mode change signal of the second level, and wherein the write address counter outputs write addresses in synchronism with the system clocks.

4. An image output apparatus according to claim 1, wherein the output circuit includes a pair of FIFO (First-In First-Out) buffers each of which stores one pixel data, wherein the asynchronous controller provides a read control signal which controls outputs of the pair of FIFO buffers so that the data stored in the pair of FIFO buffers are alternately outputted to the host controller in response to the application of the respective data request, and wherein the asynchronous controller provides a write control signal which controls a write operation of the other of the pair of the FIFO buffers which is different from one of the pair of the FIFO buffers whose data is read out to the host controller.

* * * * *